US011459827B1

(12) United States Patent
Wang et al.

(10) Patent No.: US 11,459,827 B1
(45) Date of Patent: Oct. 4, 2022

(54) FULL-METAL DYNAMIC-SEALED CONCENTRICALLY-CENTERED DOWNHOLE DISPLACEMENT MOTOR

(71) Applicant: CHINA UNIVERSITY OF GEOSCIENCES (BEIJING), Beijing (CN)

(72) Inventors: Yu Wang, Beijing (CN); Jiaxing Lu, Beijing (CN); Lingrong Kong, Beijing (CN); Baolin Liu, Beijing (CN); Kai Zhang, Beijing (CN)

(73) Assignee: CHINA UNIVERSITY OF GEOSCIENCES (BEIJING), Beijing (CN)

( * ) Notice: Subject to any disclaimer, the term of this patent is extended or adjusted under 35 U.S.C. 154(b) by 0 days.

(21) Appl. No.: 17/365,987

(22) Filed: Jul. 1, 2021

(30) Foreign Application Priority Data

Jun. 8, 2021 (CN) ..... 202110640553.3

(51) Int. Cl.
*E21B 4/02* (2006.01)
*E21B 4/00* (2006.01)

(52) U.S. Cl.
CPC ..... *E21B 4/003* (2013.01); *E21B 4/02* (2013.01)

(58) Field of Classification Search
None
See application file for complete search history.

(56) References Cited

U.S. PATENT DOCUMENTS 5,733,113 A * 3/1998 Grupping ..... E21B 4/02 418/188
5,785,509 A * 7/1998 Harris ..... F04C 13/008 418/179
5,833,444 A * 11/1998 Harris ..... E21B 4/02 418/113

FOREIGN PATENT DOCUMENTS

CN 109505728 A 3/2019

* cited by examiner

*Primary Examiner* — Giovanna Wright

(57) ABSTRACT

A full-metal dynamic-sealed concentrically-centered downhole displacement motor includes an outer tube, a stator fixed in the outer tube, a rotor rotatably connected in the stator, and a flow distribution shaft suspended in the rotor. When the rotor rotates, the plurality of circulation ports is alternately communicated with the flow distribution holes, and an accommodation space for flowing the drilling fluid is formed among the plurality of rotor copper rods; each of the circulation ports has a notch on the side of the rotor copper rod that is in communication with the accommodation space; the stator is provided with pressure relief ports for allowing the annular chamber and the accommodation space to communicate with each other, and the flow distribution hole and the pressure relief port are circumferentially arranged in a staggered manner.

10 Claims, 6 Drawing Sheets

FULL-METAL DYNAMIC-SEALED CONCENTRICALLY-CENTERED DOWNHOLE DISPLACEMENT MOTOR

CROSS-REFERENCE TO RELATED APPLICATION

The present application is based on and claims the priority benefits of China application No. 202110640553.3, filed on Jun. 8, 2021. The entirety of the above-mentioned patent application is hereby incorporated by reference herein and made a part of this specification.

BACKGROUND

Technical Field

The present application relates to the field of a motor, in particular to a full-metal dynamic-sealed concentrically-centered downhole displacement motor.

Description of Related Art

At present, drilling tools used in geological exploration, hot dry rock drilling and high temperature drilling are mainly turbodrills or screw drilling tools. Both turbodrills and screw drilling tools are downhole power drilling tools that are powered by drilling fluid and convert the pressure energy of the liquid into mechanical energy.

The turbodrill is a non-displacement downhole power motor with high speed and low torque, which is not ideal for crushing hard and harder rock formations. Therefore, when crushing hard rock formations, displacement screw drilling tools are widely used because of their high torque characteristics, which can meet the needs of hard rock formation crushing.

In a conventional screw drill motor, the stator part includes a stator metal casing and a rubber bushing. The inner chamber of the stator metal casing is a smooth cylindrical surface. Rubber is bonded to the inner wall of the stator metal casing through a vulcanization process to form the rubber bushing, and the inner hole of the rubber bushing is a continuous spiral curved surface. A rotor part is mounted in the inner hole of the rubber bushing and meshes with the rubber bushing to form a spiral sealed chamber. When drilling fluid flows through the sealed chamber, it will drive the rotor to rotate to achieve power output.

In geological exploration, hot dry rock drilling and high temperature drilling, as the downhole temperature increases, it seriously affects the performance and longevity of the screw motor when used in the well since the stator bushing made of rubber in the screw motor is not a high temperature resistant part, which cannot meet the needs of deep and ultra-deep well drilling.

SUMMARY

In order to meet the needs of high-temperature drilling in deep wells and ultra-deep wells, the present application provides a full-metal dynamic-sealed concentrically-centered downhole displacement motor.

The full-metal dynamic-sealed concentrically-centered downhole displacement motor provided in the present application adopts the following technical solutions.

A full-metal dynamic-sealed concentrically-centered downhole displacement motor, characterized by including a vertically arranged outer tube, a cylindrical stator fixed in the outer tube, a rotor rotatably connected in the stator and a flow distribution shaft hangingly mounted in the inner hole of the rotor, an annular chamber is formed between the outer tube and the stator, and the inner chamber of the stator is elliptical;

the upper end of the flow distribution shaft is used for an external drilling fluid to enter into the flow distribution shaft, the flow distribution shaft is provided with a plurality of flow distribution holes for the drilling fluid to flow out, and there are n flow distribution holes at the same cross section that are arranged equidistantly around the axis of the flow distribution shaft, wherein n is a positive integer ≥2; the side wall of the rotor is arranged with 2n accommodation slots equidistantly around the axis of the rotor, each accommodation slot accommodates a rotor copper rod, and the inner wall of the rotor is provided with circulation ports each facing one rotor copper rod, and when the rotor rotates, the plurality of circulation ports is alternately communicated with the flow distribution holes, and the rotor copper rods can slide in the accommodation slots and abut against the inner wall of the stator by the thrust of the drilling fluid in the circulation ports, and an accommodation space for the drilling fluid to flow in is formed among the plurality of rotor copper rods; each of the circulation ports has a notch on the side of the rotor copper rod that is in communication with the accommodation space; the stator is provided with a plurality of pressure relief ports for allowing the annular chamber and the accommodation space to communicate with each other, there are n pressure relief ports at the same cross section that are arranged equidistantly around the axis of the stator, and the flow distribution holes and the pressure relief ports are circumferentially arranged in a staggered manner.

By adopting the above-mentioned technical solution, after the external drilling fluid flows to the flow distribution shaft, it will reach from the flow distribution hole of the flow distribution shaft to the circulation port communicated therewith and enter the accommodation space. However, due to the alternative arrangement of the flow distribution hole and the pressure relief port, the accommodation space communicated with the flow distribution hole is a high-pressure chamber, and the adjacent accommodation space communicated with the pressure relief port as a low-pressure chamber. With the continuous injection of the external drilling fluid, the liquid in the high-pressure chamber increases. Because the inner chamber of the stator is elliptical, the liquid in the high-pressure chamber will flow in the direction of the low-pressure chamber. Therefore, the drilling fluid will finally drive the rotor to rotate and make the volume of the high-pressure the chamber increase, and the liquid in the low-pressure chamber will also reach the annulus chamber through the pressure relief port, so that the volume of the low-pressure chamber is reduced. The cycle is as such so as to realize the continuous rotation of the rotor and realize the power output. In the present application, the rotor can be driven to rotate through the cooperation of the elliptical stator inner hole and the high-pressure chamber and the low-pressure chamber to achieve power output, without using a stator bushing made of rubber material that is not resistant to high temperature, so that the motor can adapt to the higher drilling temperature at the bottom of the well and meet the needs of downhole high-temperature drilling.

Optionally, a part of the accommodation space communicated with the pressure relief port is a low-pressure chamber, and the other part of the accommodation space communicated with the flow distribution hole is a high-pressure chamber; the inner wall of the stator is embedded with stator copper rods arranged in the axial direction of the stator and located in the high-pressure chamber; there are n stator copper rods arranged equidistantly around the axis of the stator; when the low-pressure chamber communicates with the pressure relief port, the stator copper rods abut against the outer wall of the rotor or the rotor copper rods so that the low-pressure chamber and the high-pressure chamber are maintained in a state of not being communicated.

By adopting the above technical solution, the stator copper rods can have a centering and sealing effect on the rotor, and the stator copper rod in the accommodation slot that is not communicated with the flow distribution hole is prevented from retracting into the accommodation slot, causing the high-pressure chamber and the low-pressure chamber to communicate so as to affect normal power output works. At the same time, when the drilling fluid continues to enter the high-pressure chamber, the stator copper rod also gives the drilling fluid a force to push the rotor to rotate, making the rotor rotate more smoothly.

Optionally, the inner wall of the stator is provided with an upper centering ring and a lower centering ring, and the rotor is rotatably connected between the upper centering ring and the lower centering ring.

By adopting the above technical solution, the rotatable connection of the rotor and the stator can be realized through the upper centering ring and the lower centering ring.

Optionally, the lower end of the outer tube is connected with a connecting sleeve, the outer tube is sleeved at the end of the connecting sleeve, and the lower end of the stator abuts against the upper end of the connecting sleeve.

By adopting the above technical solution, the lower end of the stator can be supported by the connecting sleeve, thereby fixing the position of the stator in the outer tube.

Optionally, the outer tube is slidably connected with an upper support frame inserted into the upper end of the stator, and the flow distribution shaft is hangingly mounted in the inner hole of the rotor through the upper support frame.

By adopting the above technical solution, the radial positions of the upper end of the stator and of the outer tube can be fixed by the upper support frame, and at the same time, the stator and the flow distribution shaft can be connected together by the upper support frame to realize the suspended installation of the flow distribution shaft.

Optionally, the upper support frame is provided with an insert hole for inserting the flow distribution shaft, and a fixing ring is fixedly connected to the upper end of the flow distribution shaft, and the diameter of the fixing ring is larger than the diameter of the insertion hole.

By adopting the above technical solution, the flow distribution shaft is directly inserted into the insertion hole during installation. Since the diameter of the fixing ring is larger than the diameter of the insertion hole, the fixing ring will abut on the upper end of the upper support frame and will not fall down due to gravity. Thus, the suspension installation of the flow distribution shaft on the upper support frame is realized.

Optionally, a limit block is fixed on the side wall of the flow distribution shaft, and a limit groove for embedding the limit block is provided on the inner wall of the insertion hole.

By adopting the above technical solution, when the flow distribution shaft is inserted into the insertion hole, the limit block is also embedded in the limit groove, thereby fixing the circumferential distance of the flow distribution shaft and avoiding the flow distribution shaft rotating with the rotor so as to affect the normal flow distribution work.

Optionally, the lower end of the rotor is plugged with an output shaft, the lower end of the connecting sleeve is connected with a lower joint, the connecting sleeve is sleeved on the lower joint, and one end of the lower joint located in the connecting sleeve is used to support the output shaft.

By adopting the above technical solution, when the rotor rotates, the output shaft will be driven to rotate to realize power output, and the output shaft can be supported through the lower joint, thereby fixing the position of the output shaft.

Optionally, a limit ring is fixedly connected to the outer wall of the output shaft, and a thrust bearing is mounted between the lower side of the limit ring and the upper end of the lower joint.

By adopting the above technical solution, the arrangement of the limit ring enables the lower joint to support the output shaft, thereby fixing the axial position of the output shaft. The arrangement of the thrust bearing can reduce the friction between the limit ring and the lower joint, making the output shaft rotate more smoothly.

Optionally, the output shaft is cylindrical, and the inner hole of the output shaft communicates with the annulus chamber.

By adopting the above technical solution, the drilling fluid in the low-pressure chamber can reach the annulus chamber through the pressure relief port, and finally flow out from the inner hole of the output shaft.

In summary, the present application includes at least one of the following beneficial technical effects:

1. In the present application, by designing the cooperation of the elliptical stator inner hole and the high-pressure chamber and the low-pressure chamber, the rotor can be driven to rotate through the drilling fluid to achieve power output, without using a stator bushing made of rubber material that is not resistant to high temperature, so that the motor can adapt to the higher drilling temperature at the bottom of the well and meet the needs of downhole high-temperature drilling;

2. The arrangement of the stator copper rod can increase the seal between the rotor and the stator, avoid the communication of the high-pressure chamber and the low-pressure chamber, and also increase the torque that drives the rotor to rotate, making the rotor rotate more smoothly. When the rotor is rotating, the stator copper rod can also play the role of centering of the rotor and improve the running stability of the rotor;

3. The suspension installation of the flow distribution shaft prevents the flow distribution shaft from obstructing the rotation of the rotor, and prevents the rotor from failing due to excessive water pressure.

Description of Reference Signs: 1. outer tube; 11. connecting sleeve; 12. upper support frame; 121. insert slot; 122. insert hole; 123. limit groove; 13. lower joint; 14. lower support frame; 15. upper joint; 2. stator; 21. pressure relief port; 22. embedding slot; 23. stator copper rod; 24. mounting slot; 3. rotor; 31. accommodation slot; 32. rotor copper rod; 33. circulation port; 34. notch; 35. upper centering ring; 36. lower centering ring; 37. auxiliary rod; 4. flow distribution shaft; 41. flow distribution hole; 42. fixing ring; 43. limit block; 51. annular chamber; 52. accommodation space; 521. high-pressure chamber; 522. low-pressure chamber; 53. placing chamber; 6. output shaft; 61. connecting shaft; 62. main shaft; 621. limit ring; 622. auxiliary groove; 63. thrust bearing; 64. first radial bearing; 65. second radial bearing.

DESCRIPTION OF THE EMBODIMENTS

The present application will be further described in detail below in conjunction with attached FIGS. 1-6.

Figure 1:
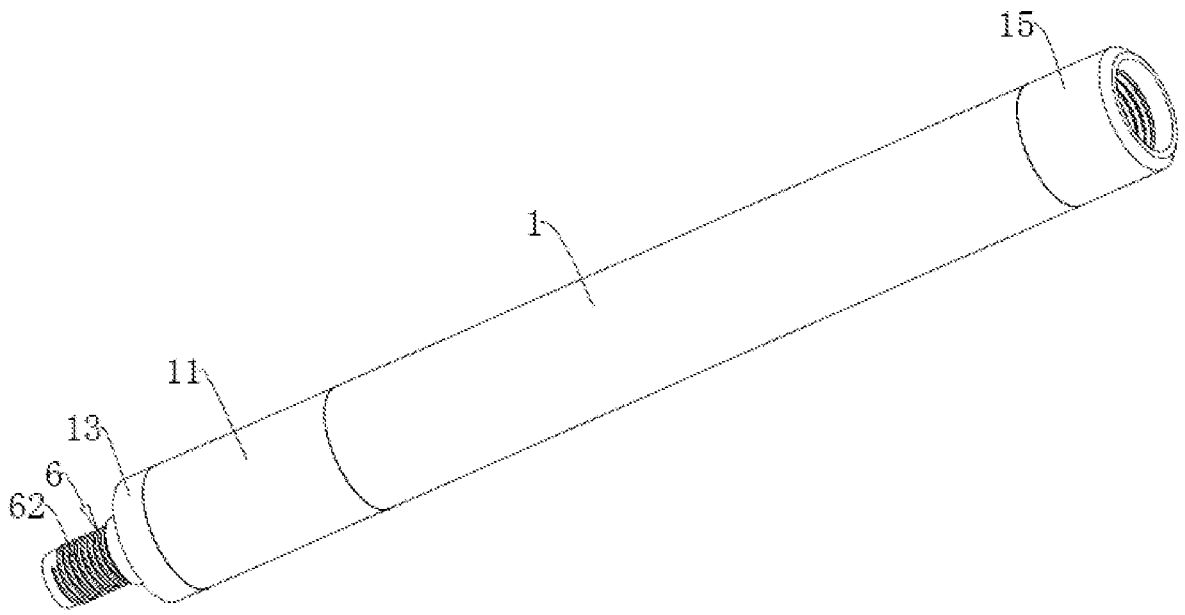
FIG. 1 is a schematic diagram of the overall structure of the present application.
Figure 2:
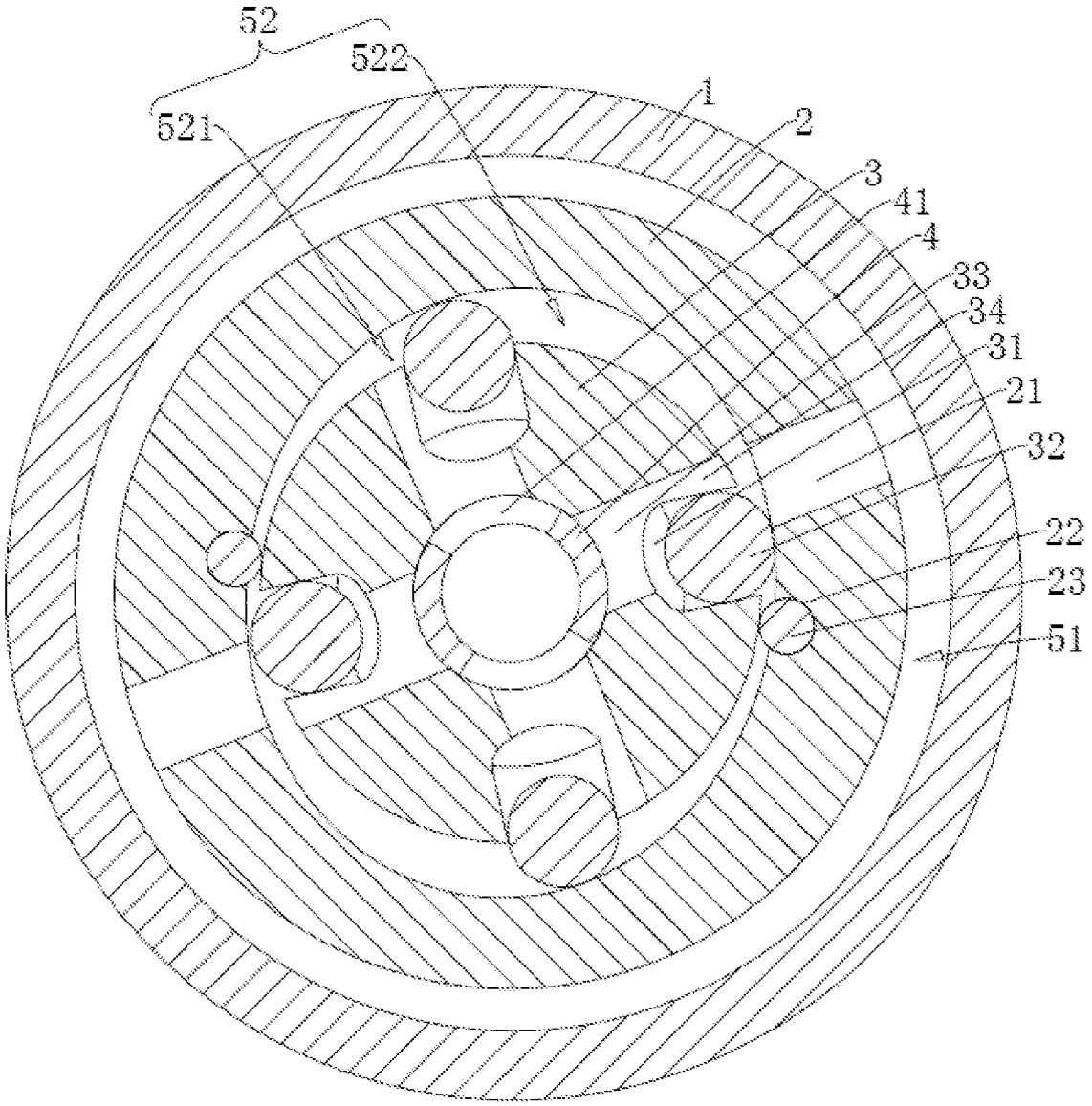
FIG. 2 is a schematic front sectional view of the present application.

The embodiment of the present application discloses a full-metal dynamic-sealed concentrically-centered downhole displacement motor. Referring to FIGS. 1 and 2, the downhole displacement motor includes a vertically arranged outer tube 1, a cylindrical stator 2 fixed in the outer tube 1, a rotor 3 rotatably connected in the stator 2, and a flow distribution shaft 4 hangingly mounted in the inner hole of the rotor 3. Here, the inner chamber of the stator 2 is elliptical, and the outer tube 1 and the stator 2 do not contact each other to form an annular chamber 51.

Figure 3:
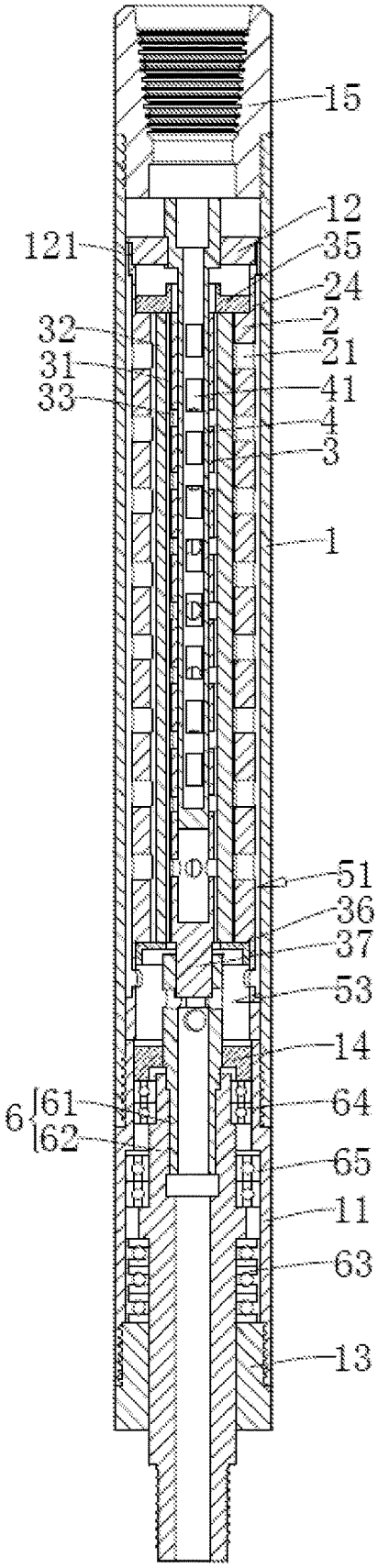
FIG. 3 is a schematic top sectional view of the present application.

Referring to FIGS. 2 and 3, the upper end of the flow distribution shaft 4 is connected with the external drilling fluid, so that the external drilling fluid can smoothly enter the inner hole of the flow distribution shaft 4. The flow distribution shaft 4 is also provided with a plurality of flow distribution holes 41 for the drilling fluid to flow out. There are n flow distribution holes 41 at the same cross section that are arranged equidistantly around the axis of the flow distribution shaft 4, where n is a positive integer ≥2, preferably, n=2 is taken as an example for description in the present application, and two flow distribution holes 41 are symmetrically provided at the same cross section. At the side wall of the rotor 3, there are 2n accommodation slots 31 equidistantly around the axis of the rotor 3, that is, four accommodation slots 31 are provided. The inner wall of the rotor 3 is provided with circulation port 33 each facing one rotor copper rod 32. When the rotor 3 rotates, the flow distribution holes 41 can alternately communicate with the circulation ports 33, and the drilling fluid flowing from the outside to the inner hole of the flow distribution shaft 4 will also flows into the circulation ports 33 from the flow distribution holes 41 communicated therewith, and pushes the rotor copper rod 32 to slide in the accommodation slot 31 so that the rotor copper rod 32 abuts on the inner wall of the stator 2. At this time, an accommodation space 52 for the drilling fluid to flow in is formed between every two rotor copper rods 32.

Wherein, each of the circulation ports 33 has a notch 34 on the side of the rotor copper rod 32 that is in communication with the accommodation space 52, so that the drilling fluid in the flow distribution shaft 4 can reach the circulation port 33 from the flow distribution holes 41 communicated therewith, and reach the accommodation space 52 through the notch 34, and at this time, the accommodation space 52 communicated with the flow distribution hole 41 is a high-pressure chamber 521. At the same time, the stator 2 is provided with a plurality of pressure relief ports 21 for allowing the annular chamber 51 and the accommodation space 52 to communicate with each other. There are n pressure relief ports 21 at the same cross section that are arranged equidistantly around the axis of the stator 2, that is, there are two pressure relief ports 21 at the same cross section that are arranged equidistantly around the axis of the stator 2. And the flow distribution holes 41 and the pressure relief ports 21 at the same cross section are arranged in a staggered manner, so that each accommodation space 52 can be alternatively communicated with the flow distribution holes 41 and pressure relief ports 21, that is, the accommodation space 52 adjacent to the high-pressure chamber 521 is communicated with the pressure relief port 21 to form the low-pressure chamber 522, and finally form the high-pressure chambers 521 and the low-pressure chambers 522 arranged in a staggered manner. After the external drilling fluid reaches the flow distribution shaft 4, it can reach the circulation port 33 communicated with the flow distribution hole 41 from the flow distribution hole 41, and reach the accommodation space 52 to form the high-pressure chamber 521, and an accommodation space 52 adjacent to the high-pressure chamber 521 is communicated with the pressure relief port 21 to form the low-pressure chamber 522. As the drilling fluid continues to enter the high-pressure chamber 521, the liquid in the high-pressure chamber 521 will push the rotor 3 to rotate in the direction of the low-pressure chamber 522. As shown in FIG. 2, in order to allow more drilling fluid to enter, the high-pressure chamber 521 will push the rotor 3 to rotate clockwise, so that the volume of the high-pressure chamber 521 gradually increases, and the drilling fluid in the low-pressure chamber 522 also flows out from the pressure relief port 21. The cycle is as such so as to drive the rotor 3 to continuously rotate and realize the power output.

Here, in order to avoid that, when the rotor 3 rotates, the rotor copper rod 32 at the circulation port 33 that is not communicated with the flow distribution hole 41 is retracted into the accommodation slot 31 so that two adjacent accommodation spaces 52 are communicated, that is, the high-pressure chamber 521 and the low-pressure chamber 522 are communicated, thereby affecting the normal rotation of the rotor 3. an embedding slot 22 is provided on the inner wall of the stator 2 near the pressure relief port 21. The stator copper rod 23 is located in the high-pressure chamber 521. The stator copper rod 23 is rotatably connected in the embedding slot 22. The length direction of the stator copper rod 23 is the same as the axial direction of the stator 2. There are n stator copper rods 23, that is, there are two stator copper rods 23 in the present application, and the two stator copper rods 23 correspond to the two pressure relief openings 21 at the same cross section one by one. When the rotor 3 rotates, the side wall of the stator copper rod 23 always abuts against the outer wall of the rotor 3 or the rotor copper rod 32 so that the high-pressure chamber 521 and the low-pressure chamber 522 always are maintained in a state of not being communicated, ensuring the seal between the high-pressure chamber 521 and the low-pressure chamber 522. At the same time, the design of the stator copper rod 23 can also enable that when the drilling fluid enters the high-pressure chamber 521, the stator copper rod 23 will give the drilling fluid a force to push the rotor 3 to rotate, making the rotor 3 rotate more smoothly; and multiple stator copper rods 23 can play the role of centering of the rotor 3. Since the stator copper rod 23 is in rolling contact with the rotor 3, the friction between the stator 2 and the rotor 3 can be greatly reduced, so that the rotor 3 can rotate more smoothly.

Figure 4:
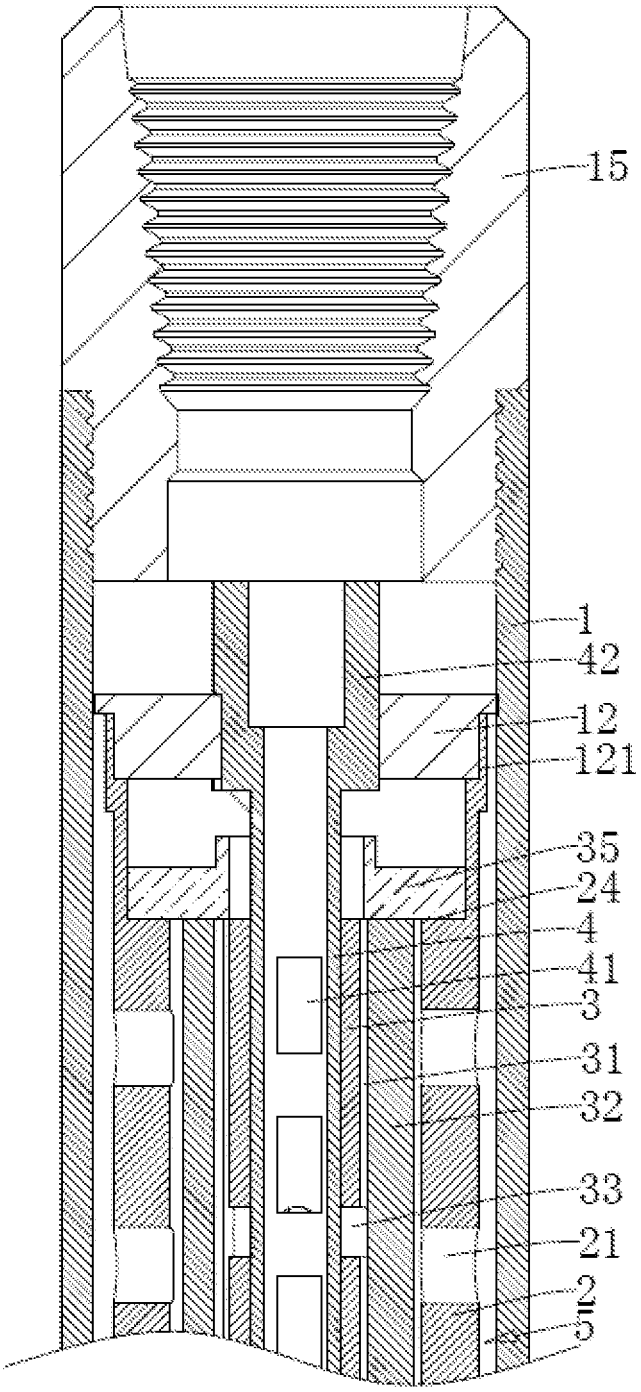
FIG. 4 is a schematic cross-sectional view of the present application showing a connection between the upper support frame and the stator, and the upper centering ring and the stator.

Referring to FIGS. 3 and 4, the upper end of the stator 2 is provided with a mounting slot 24 provided in the inner hole of the stator 2. An upper centering ring 35 is provided in the mounting slot 24. A lower centering ring 36 is fixed on the inner wall of the stator 2 close to the lower end of the stator 2. The rotor 3 is rotatably connected between the upper centering ring 35 and the lower centering ring 36 to fix the position of the rotor 3 so that the rotor 3 can rotate in the inner hole of the stator 2.

Figure 5:
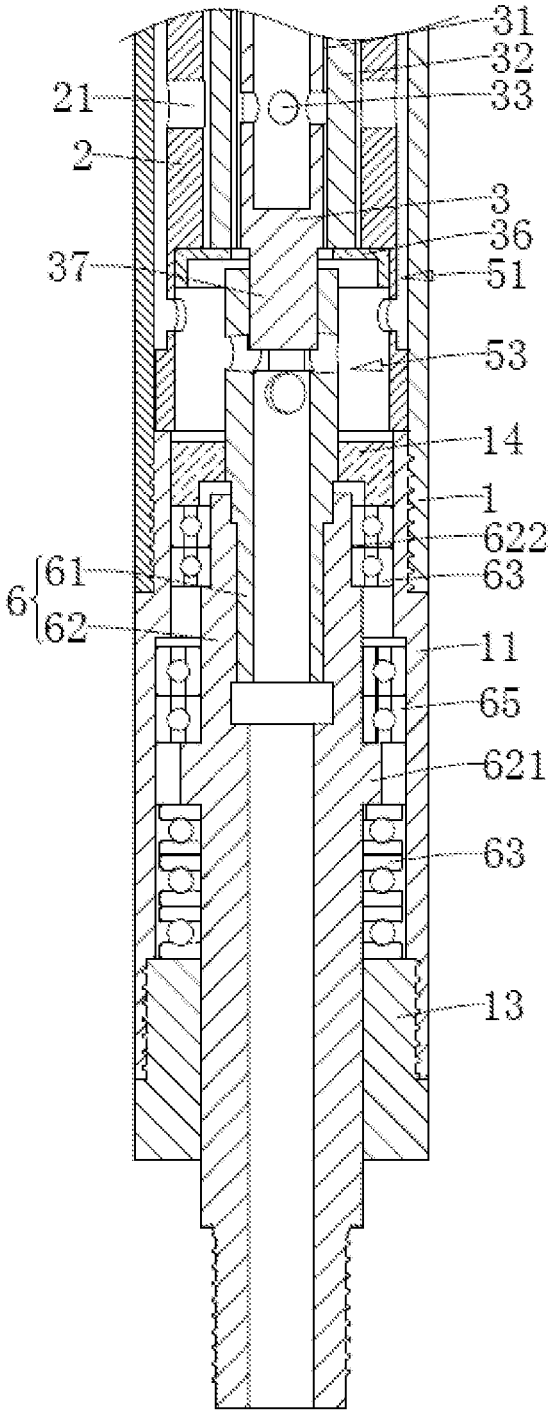
FIG. 5 is a schematic diagram showing a connection between the lower support frame and the main shaft, and the lower centering ring and the stator.

Referring to FIGS. 3 and 5, the lower end of the outer tube 1 is threadedly connected with a connecting sleeve 11. Specifically, the lower end of the outer tube 1 is machined with internal threads, and the upper end of the connecting sleeve 11 is machined with external threads. When the connecting sleeve 11 is threadedly connected to the outer tube 1, the upper end of the connecting sleeve 11 is located in the outer tube 1 and forms a stepped surface, and the lower end of the stator 2 is provided on the upper end of the connecting sleeve 11 so that the connecting sleeve 11 can support the stator 2 so as to fix the position of the stator 2 in the outer tube 1.

Referring to FIG. 4, an upper support frame 12 is slidably connected in the outer tube 1, and the upper support frame 12 is insertedly mated with the upper end of the stator 2. Specifically, the upper support frame 12 is provided with a insert slot 121 for the upper end of the stator 2 to be inserted. The support frame 12 can fix the radial position of the upper end of the stator 2.

Figure 6:
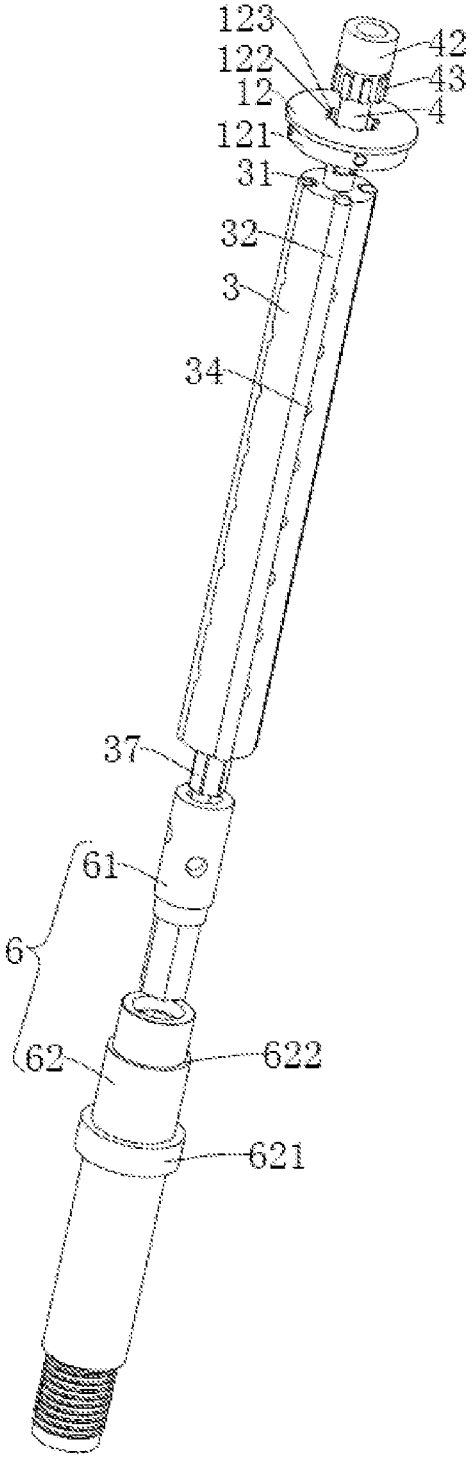
FIG. 6 is a partial exploded schematic diagram showing a connection between the rotor and the output shaft.

Referring to FIGS. 4 and 6, the flow distribution shaft 4 is suspended from the upper support frame 12. Specifically, the upper support frame 12 is provided with an insertion hole 122 for the flow distribution shaft 4 to be inserted, and a fixing ring 42 is fixed on the outer wall of the flow distribution shaft 4, and is located at the upper end of the flow distribution shaft 4, wherein the diameter of the fixing ring 42 is larger than the diameter of the insertion hole 122, so that when the flow distribution shaft 4 is inserted into the insertion hole 122, the fixing ring 42 can be clamped on the upper side of the upper support frame 12 so as to fix the position of the flow distribution shaft 4. At the same time, the suspension arrangement of the flow distribution shaft 4 also prevents the flow distribution shaft 4 from interfering with the rotor 3, and avoids the failure of the rotor 3 caused by gravity, that is generated by the water pressure on the flow distribution shaft 4, acting on the rotor 3.

Here, in order to fix the circumferential position of the flow distribution shaft 4, a limit block 43 is also fixed on the side wall of the flow distribution shaft 4, and is located at the end of the flow distribution shaft 4 facing the fixing ring 42. There are a plurality of limit rings 621 arranged equidistantly around the axis of the flow distribution shaft 4. At the same time, the upper support frame 12 is provided with a limit groove 123 for the limit block 43 to slide. When the flow distribution shaft 4 is mounted in the insertion hole 122, the limit block 43 also slides in the limit groove 123 so as to fix the circumferential position of the flow distribution shaft 4 and prevent the flow distribution shaft 4 from rotating with the rotor 3 so as to affect the normal distribution work.

Referring to FIGS. 5 and 6, an output shaft 6 is provided at the lower end of the rotor 3, and the output shaft 6 is used to connect with a drill bit to meet the needs of bottom hole drilling. And a lower joint 13 is threadedly connected to the lower end of the connecting sleeve 11. Specifically, an internal thread is machined at the lower end of the connecting sleeve 11, and an external thread is machined on the upper end of the lower joint 13. When the lower joint 13 is threadedly connected to the connecting sleeve 11, the part of the joint 13 located in the connecting sleeve 11 forms a stepped surface for supporting the output shaft 6 so as to support the output shaft 6 and fix the axial position of the output shaft 6.

Specifically, an auxiliary rod 37 is fixedly connected to the lower end of the rotor 3, and the auxiliary rod 37 has a non-circular cross section. The output shaft 6 includes a connecting shaft 61 that is inserted and matched with the auxiliary rod 37, and a main shaft 62 that is inserted and matched with an end of the connecting shaft 61 away from the auxiliary rod 37. The end of the connecting shaft 61 away from the auxiliary rod 37 is also non-circular. Specifically, the auxiliary rod 37 and the end of the connecting shaft 61 away from the auxiliary rod 37 may be regular polygons, ellipses, irregular shapes, etc., as long as they can realize, when the rotor 3 rotates, to drive the connecting shaft 61 and the main shaft 62 to rotate synchronously. The present application takes an example that the cross sections of the auxiliary rod 37 and of the end of the connecting shaft 61 away from the auxiliary rod 37 each are regular hexagons.

Here, a limit ring 621 is fixed on the outer wall of the main shaft 62, and the limit ring 621 abuts on the end of the lower joint 13 in the connecting sleeve 11, thereby fixing the position of the main shaft 62 in the lower joint 13. The connecting shaft 61 is clamped between the main shaft 62 and the rotor 3, so that the axial positions of the main shaft 62 and of the connecting shaft 61 can be fixed. At the same time, in order to reduce the friction between the limit ring 621 and the lower joint 13 when the main shaft 62 rotates with the rotor 3, three thrust bearings 63 are mounted between the limit ring 621 and the lower joint 13. The thrust bearings 63 can reduce the friction between the limit ring 621 and the lower joint 13, makings the main shaft 62 rotate more smoothly.

Referring to FIGS. 5 and 6, an auxiliary groove 622 is provided at the upper end of the main shaft 62 at the outer wall of the main shaft 62, so that the side wall of the auxiliary groove 622 forms a stepped surface. A first radial bearing 64 is provided between the main shaft 62 and the inner wall of the connecting sleeve 11, and is provided on the stepped surface formed by the side wall of the auxiliary groove 622, so as to fix the axial position of the first radial bearing 64.

At the same time, a lower support frame 14 is provided on the first radial bearing 64. The lower support frame 14 rotates and cooperates with the main shaft 62. The lower support frame 14 can fix the radial position of the upper end of the main shaft 62 to avoid shaking when the main shaft 62 rotates. At the same time, the main shaft 62 and the connecting shaft 61 are both cylindrical. A placement chamber 53 is formed between the upper side of the lower support frame 14 and the inner wall of the stator 2. The placement chamber 53 is in communication with the annular chamber 51 and the inner hole of the output shaft 6, so that the drilling fluid in the annulus chamber 51 can reach the inner hole of the output shaft 6 through the placement chamber 53 and is finally output from the inner hole of the output shaft 6, facilitating subsequent drilling work.

Here, a second radial bearing 65 is further provided between the main shaft 62 and the connecting sleeve 11, and the second radial bearing 65 is placed on the limit ring 621, which can reduce the friction between the main shaft 62 and the connecting sleeve 11.

Referring to FIG. 4, in order to facilitate the installation of the motor, an upper joint 15 is threadedly connected to the upper end of the outer tube 1, and a drilling tool can be connected to the outer tube 1 through the upper joint 15 to realize the liquid supply to the flow distribution shaft 4.

At the same time, the motor is made of all metal material and does not contain parts not resistant to high temperatures such as rubber, so that the motor can be used in high temperature environments to meet the needs of downhole high temperature drilling and have a longer service life.

The implementation principle of the full-metal dynamic-sealed concentrically-centered downhole displacement motor in the embodiment of the present application is as follows. When in use, a pipe that transports the drilling fluid from the outside is directly connected to the upper joint 15, and the centernal drilling fluid will be directly transported to the flow distribution shaft 4, and from the flow distribution hole 41 through the circulation port 33 communicated therewith to the accommodation space 52, so that the accommodation space 52 forms a high-pressure chamber 521, and an adjacent accommodation space 52 communicates with the pressure relief port 21 to form a low-pressure chamber 522. With the continuous injection of drilling fluid, the drilling fluid in the high-pressure chamber 521 will push the rotor 3 through the rotor copper rod 32 to rotate toward the low-pressure chamber 522 to increase the volume of the high-pressure chamber 521. At this time, the drilling fluid in the low-pressure chamber 522 also flows from the pressure relief port 21 to the annulus chamber 51, and reaches the inner hole of the output shaft 6 through the placement chamber 53, and finally discharges from the inner hole of the output shaft 6. As the rotor 3 rotates, the two adjacent circulation ports 33 alternately communicate with the flow distribution hole 41, so that the high-pressure chamber 521 and the low-pressure chamber 522 are alternately exchanged, thereby driving the rotor 3 to continuously rotate, and the rotor 3 also drives the connecting shaft 61 and the main shaft 62 to rotate to achieve power output. The rotor 3 and the stator 2 are dynamically sealed by the rotor copper rods 32 and the stator copper rods 23, which can greatly reduce the friction between the rotor 3 and the stator 2 while ensuring the sealing, making the rotor 3 run more smoothly and greatly extending the service life. And because the motor as a whole does not contain parts not resistant to high temperatures such as rubber, the motor can meet the needs of high-temperature downhole drilling with better performance.

The above are the preferred embodiments of the present application, and the scope of protection of the present application is not limited accordingly. Therefore, all equivalent changes made in accordance with the structure, shape and principle of the present application shall be covered by the scope of protection of the present application.

What is claimed is:

1. A full-metal dynamic-sealed concentrically-centered downhole displacement motor, comprising a vertically arranged outer tube (1), a cylindrical stator (2) fixed in the outer tube (1), a rotor (3) rotatably connected in the stator (2) and a flow distribution shaft (4) hangingly mounted in an inner hole of the rotor (3), wherein an annular chamber (51) is formed between the outer tube (1) and the stator (2), and an inner chamber of the stator (2) is elliptical; an upper end of the flow distribution shaft (4) is used for an external drilling fluid to enter into the flow distribution shaft, the flow distribution shaft (4) is provided with a plurality of flow distribution holes (41) for the drilling fluid to flow out, and there are n flow distribution holes (41) at a same cross section that are arranged equidistantly around the axis of the flow distribution shaft (4), wherein n is a positive integer ≥2; a side wall of the rotor (3) is arranged with 2n accommodation slots (31) equidistantly around the axis of the rotor (3), each accommodation slot (31) accommodates a rotor copper rod (32), and an inner wall of the rotor (3) is provided with circulation ports (33) each facing one rotor copper rod (32), and when the rotor (3) rotates, the plurality of circulation ports (33) is alternately communicated with the flow distribution holes (41), and the rotor copper rods (32) can slide in the accommodation slots (31) and abut against an inner wall of the stator (2) by a thrust of the drilling fluid in the circulation ports (33), and an accommodation space (52) for the drilling fluid to flow in is formed among the plurality of rotor copper rods (32); each of the circulation ports (33) has a notch (34) on a side of the rotor copper rod (32) that is in communication with the accommodation space (52); the stator (2) is provided with n pressure relief ports (21) for allowing the annular chamber (51) and the accommodation space (52) to communicate with each other, the pressure relief ports (21) are at a same cross section and are arranged equidistantly around the axis of the stator (2), and the flow distribution holes (41) and the pressure relief ports (21) are circumferentially arranged in a staggered manner.

2. The full-metal dynamic-sealed concentrically-centered downhole displacement motor according to claim 1, wherein a part of the accommodation space (52) communicated with one of the pressure relief ports (21) is a low-pressure chamber (522), and the other part of the accommodation space (52) communicated with one of the flow distribution holes (41) is a high-pressure chamber (521); the inner wall of the stator (2) is embedded with n stator copper rods (23) arranged in an axial direction of the stator (2) and located in the high-pressure chamber (521); the stator copper rods (23) are arranged equidistantly around the axis of the stator (2); when the low-pressure chamber (522) communicates with one of the pressure relief ports (21), the stator copper rods (23) abut against an outer wall of the rotor (3) or the rotor copper rods (32) so that the low-pressure chamber (522) and the high-pressure chamber (521) are maintained in a state of not being communicated.

3. The full-metal dynamic-sealed concentrically-centered downhole displacement motor according to claim 1, wherein the inner wall of the stator (2) is provided with an upper centering ring (35) and a lower centering ring (36), and the rotor (3) is rotatably connected between the upper centering ring (35) and the lower centering ring (36).

4. The full-metal dynamic-sealed concentrically-centered downhole displacement motor according to claim 1, wherein a lower end of the outer tube (1) is connected with a connecting sleeve (11), the outer tube (1) is sleeved at the end of the connecting sleeve (11), and a lower end of the stator (2) abuts against an upper end of the connecting sleeve (11).

5. The full-metal dynamic-sealed concentrically-centered downhole displacement motor according to claim 4, wherein the outer tube (1) is slidably connected with an upper support frame (12) inserted into an upper end of the stator (2), and the flow distribution shaft (4) is hangingly mounted in the inner hole of the rotor (3) through the upper support frame (12).

6. The full-metal dynamic-sealed concentrically-centered downhole displacement motor according to claim 5, wherein the upper support frame (12) is provided with an insert hole (122) for inserting the flow distribution shaft (4), and a fixing ring (42) is fixedly connected to the upper end of the flow distribution shaft (4), and a diameter of the fixing ring (42) is larger than a diameter of the insertion hole (122).

7. The full-metal dynamic-sealed concentrically-centered downhole displacement motor according to claim 6, wherein a limit block (43) is fixed on a side wall of the flow distribution shaft (4), and a limit groove (123) for embedding the limit block (43) is provided on an inner wall of the insertion hole (122).

8. The full-metal dynamic-sealed concentrically-centered downhole displacement motor according to claim 4, wherein a lower end of the rotor (3) is plugged with an output shaft (6), a lower end of the connecting sleeve (11) is connected with a lower joint (13), the connecting sleeve (11) is sleeved on the lower joint (13), and one end of the lower joint (13) located in the connecting sleeve (11) is used to support the output shaft (6).

9. The full-metal dynamic-sealed concentrically-centered downhole displacement motor according to claim 8, wherein a limit ring (621) is fixedly connected to an outer wall of the output shaft (6), and a thrust bearing (63) is mounted between a lower side of the limit ring (621) and an upper end of the lower joint (13).

10. The full-metal dynamic-sealed concentrically-centered downhole displacement motor according to claim 8, wherein the output shaft (6) is cylindrical, and an inner hole of the output shaft (6) communicates with the annulus chamber (51).

* * * * *